United States Patent [19]

Chasteen

[11] 4,132,269

[45] Jan. 2, 1979

[54] GENERATION OF ELECTRICITY DURING THE INJECTION OF A DENSE FLUID INTO A SUBTERRANEAN FORMATION

[75] Inventor: Anthony J. Chasteen, Brawley, Calif.

[73] Assignee: Union Oil Company of California, Brea, Calif.

[21] Appl. No.: 869,603

[22] Filed: Jan. 16, 1978

[51] Int. Cl.[2] ..... E21B 43/20; F03G 7/04

[52] U.S. Cl. ..... 166/268; 166/65 R; 166/305 R; 60/641; 290/52

[58] Field of Search ..... 166/248, 252, 268, 305 R, 166/305 D, 244 R, 65 R; 299/4, 5; 175/150; 60/641; 165/45; 290/52

[56] References Cited

U.S. PATENT DOCUMENTS

| | | | |
|---|---|---|---|
| 1,247,520 | 11/1917 | Fessenden | 290/55 |
| 2,978,634 | 4/1961 | Arps | 175/50 X |
| 3,140,986 | 7/1964 | Hubbard | 60/641 X |
| 3,258,069 | 6/1966 | Hottman | 166/252 |
| 3,288,648 | 11/1966 | Jones | 166/248 UX |
| 3,298,435 | 1/1967 | Schoenfeld et al. | 166/268 |
| 3,342,267 | 9/1967 | Cotter et al. | 166/65 R |
| 3,627,048 | 12/1971 | Roeder | 166/305 R |
| 3,857,244 | 12/1974 | Faucette | 60/641 |
| 3,939,356 | 2/1976 | Loane | 290/52 |
| 4,050,516 | 9/1977 | Canterbury | 166/305 R |

FOREIGN PATENT DOCUMENTS

| | | | |
|---|---|---|---|
| 2401024 | 7/1975 | Fed. Rep. of Germany | 60/641 |

OTHER PUBLICATIONS

Armstead, "Some Unusual Ways of Developing Power from a Geothermal Field," *Proceedings: Second United Nations Symposium on the Development and Use of Geothermal Resources,* May 1975, pp. 1897, 1903, 1904.

Chasteen, "Geothermal Steam Condensate Reinjection," Ibid, pp. 1335, 1336.

Scott, "Hydropower from Underground Pumped Storage," *Energy Sources,* vol. 2, No. 2, Sept. 1975, pp. 217–227.

*Primary Examiner*—Ernest R. Purser
*Assistant Examiner*—George A. Suchfield
*Attorney, Agent, or Firm*—Richard C. Hartman; Dean Sandford; Daniel R. Farrell

[57] ABSTRACT

Electricity is generated during the injection of a dense fluid through an injection well and into a subterranean formation having a connate fluid pressure less than the available downhole pressure of injection fluid in the injection well. A fluid engine/generator is positioned in the well to define upper and lower zones in the well; a level of dense fluid is established in the upper zone; and dense fluid is flowed from the upper zone through the fluid engine/generator and into the subterranean formation to thereby generate electricity, which is subsequently recovered. Control of the downhole fluid pressure is also achieved.

15 Claims, 3 Drawing Figures

GENERATION OF ELECTRICITY DURING THE INJECTION OF A DENSE FLUID INTO A SUBTERRANEAN FORMATION

BACKGROUND OF THE INVENTION

Field of the Invention

The invention relates to processes in which a dense fluid is injected into a subterranean formation, and particularly to a method for generating electricity utilizing the excess downhole pressure of a fluid flowing through an injection well and into a subterranean formation Description of the Prior Art There are a wide variety of injection operations in which a dense fluid is injected into the earth, including the disposal of liquid waste streams from urban or industrial plants, the reinjection of effluent liquids from a geothermal power plant, the injection of displacement fluids in the various enhanced oil recovery processes wherein the injected fluid is employed to displace oil and/or gas from a subterranean formation, and the injection of leaching solutions into a subterranean formation to recover mineral values therefrom. Operations which require fluid injection, or in which fluid injection is desirable, have at least one well communicating between the surface location from which the fluid is to be injected and the subterranean formation into which the fluid is to be injected. These wells vary in depth from several feet to several thousand feet and more, depending of course upon the location of the particular subterranean formation relative to the surface location. For example, wells employed in enhanced oil recovery methods vary in depth from less than about 500 feet to 25,000 feet or more, with wells on the order of 2,000 to 10,000 feet being common.

The subterranean formations into which the fluids are injected contain a naturally occurring fluid and/or a previously injected fluid, herein collectively referred to as the "connate fluid", which exerts a back pressure, herein called the "connate fluid pressure", in resistance to the injection operation. This resistance must be overcome by some positive pressure supplied in the injection operation. In some cases, the positive pressure is supplied by external pumps or compressors; however in many cases, external devices are not required because the hydrostatic head of the fluid column in the injection well inherently formed in the operation provides sufficient positive pressure to force the fluid into the formation. In these latter cases, an equilibrium fluid level, herein called the "dynamic level", will be established in the well at a point between the earth surface and the formation. The location of the dynamic level will depend, inter alia, upon the connate fluid pressure and the fluid injection rate. Above the dynamic level there exists a relatively empty portion of the well which, if it were to be filled with the fluid, would provide additional hydrostatic head. Thus, in these injection operations there is available a hydrostatic head in excess of that required to force the fluid into the formation at the desired rate. The method of this invention utilizes this available, but previously unused, excess hydrostatic head to generate electrical energy.

One problem with the injection of fluids into relatively pressure-sensitive formations, such as unconsolidated formations, is that the high downhole pressures inherently produced in some fluid injection operations may result in a reduction in well injectivity. Reduced well injectivity, of course, requires a higher pressure for the same fluid flow rate which higher pressure results in a further reduction in well injectivity. Such operations would benefit from a method of controlling the downhole pressure during the injection operation.

A method for downhole pressure control would also benefit some of the enhanced oil recovery processes in which a displacement fluid comprised of a highly pressurized, normally gaseous fluid is injected into an oil-bearing formation to miscibly displace the oil through the formation to a production well. To achieve miscible-displacement, the normally gaseous fluid must be highly compressed to form a dense fluid, and is therefore introduced into the top of the injection well at an elevated pressure. The fluid pressure adjacent the formation in the prior art injection method would then be equal to this high surface pressure plus the hydrostatic head of the dense fluid column in the well. Where this downhole pressure is in excess of the desired formation flooding pressure, as will occur in relatively deep wells, the compression requirement of the operation will be increased. Thus, there exists a need for controlling the excess downhole fluid pressure in these injection operations.

Accordingly, it is a primary object of this invention to utilize the excess potential energy available during the injection of a dense fluid through an injection well and into a subterranean formation, without adversely affecting the injection operation itself.

Another object of the invention is to utilize the available excess hydrostatic head of a dense fluid flowing through an injection well and into a subterranean formation to generate electrical energy.

Still another object of this invention is to provide an improved method for controlling the flow of a dense fluid through an injection well and into a subterranean formation, in which the available excess hydrostatic head of injection fluid in the well is utilized for the generation of electricity.

Yet another object of this invention is to provide a method for controlling the downhole pressure exerted on a subterranean formation during the injection of a dense fluid through an injection well and into the formation, in which the excess pressure is utilized for the generation of electricity.

Further objects, advantages and features of the invention will become apparent to those skilled in the art from the following description taken in conjunction with the accompanying drawings.

SUMMARY OF THE INVENTION

Briefly, the invention provides an improved method for the injection of a dense fluid through an injection well and into a subterranean formation which has a connate fluid pressure less than the available downhole pressure of the dense fluid in the injection wall. In the method, a fluid engine/generator is positioned in the injection well and the fluid to be injected is flowed through the fluid engine/generator enroute to the subterranean formation, thereby providing motive power for the generation of electricity. The electricity is transmitted to the surface for use in a conventional manner.

In one embodiment of the method of this invention, a normally gaseous fluid, such as a gas condensate, is injected under pressure through an injection well into a subterranean oil-bearing formation to miscibly displace the oil through the formation to a production well. The downhole pressure of the fluid is controlled at the desired displacement pressure, and electrical energy is produced, by flowing the fluid through a fluid engine/-generator positioned in the well, thereby converting the potential energy represented by the downhole fluid pressure in excess of the desired displacement pressure to electrical energy. Compression requirements are minimized by controlling the formation pressure at the desired displacement pressure.

The method of this invention allows production of electrical energy from a previously unused energy source without adversely affecting, and in some cases actually beneficially affecting, the injection operation. The method provides electricity at relatively remote locations and results in an environmental benefit in that it reduces or eliminates the necessity of environmentally objectionable alternative energy sources, such as the burning of fossil fuel to fire a power plant. The method may be used to smooth out the peak load of a geothermal power plant, or reduce the amount of power purchased or generated in costly surface facilities to supply energy for enhanced oil recovery processes.

BRIEF DESCRIPTION OF THE DRAWINGS

The invention will be more readily understood by reference to the drawings, of which.

DETAILED DESCRIPTION OF THE INVENTION

Figure 1:
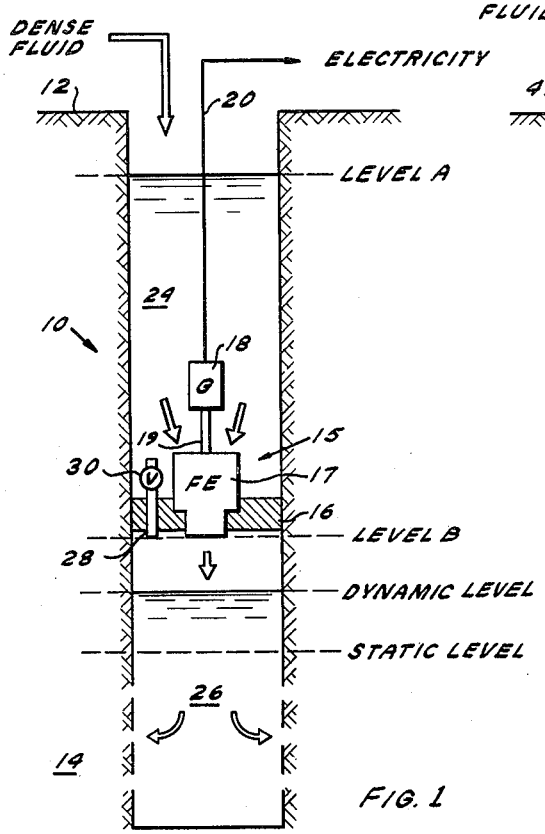
FIG. 1 is a schematic drawing of a cross-section of earth strata penetrated by an injection well illustrating one embodiment of the method of this invention.

The method of the invention is applicable to any operation in which a fluid is injected through an injection well into a subterranean formation provided that the available downhole pressure of the fluid in the well exceeds the connate fluid pressure of the subterranean formation. The invention is applicable, as a practical matter, to the injection of relatively dense fluids, such as water, brine, or pressurized gas condensates, into a subterranean formation. "Dense fluid" as used herein includes both liquids and highly pressurized, normally gaseous fluids, which under the conditions encountered are condensed liquids or dense fluids which are at temperatures above their critical temperature. Exemplary liquids include both aqueous and oleaginous liquids. Exemplary normally gaseous fluids include the hydrocarbons having from 1 to 6 carbon atoms per molecule, carbon dioxide and nitrous oxide when such fluids are highly compressed to a relatively dense liquid-like state at temperatures above their critical temperatures. Suitable injection processes include: the injection of a displacement medium, such as carbon dioxide, water or other aqueous fluid, into a subterranean formation for the recovery of oil or other minerals contained therein; the disposal of fluid wastes from a chemical or sewage disposal plant; and the storage of water or other dense fluids in a subterranean formation.

In most of the liquid injection operations, the excess downhole pressure used to generate electricity results from the hydrostatic head of a column of a liquid in the injection well, however any available externally generated pressure can also be used. During the injection of compressed fluids, such as carbon dioxide or other gas condensates, the fluid is externally pressurized before introduction to the well and the excess downhole pressure used to generate electricity can comprise at least a portion of the increased downhole fluid pressure which is due to the hydrostatic head of the dense fluid column in the injection well.

In addition to producing electricity, the method of this invention may also benefit the injection process itself. Often formation damage occurs when high fluid pressures are exerted on an unconsolidated or semi-consolidated formation which may result in formation particle movement and a substantial reduction in well injectivity. Excessive pressures can also result in formation fracturing which may adversely affect fluid mobility control in the formation. The method of this invention allows the operator to control the pressure exerted on the formation face by adjusting the location of and/or the pressure drop across the fluid engine/generator. Also some enhanced oil recovery processes, such as the carbon dioxide miscible-displacement processes, require careful control of the subterranean formation pressure in order to maximize oil recovery while keeping compression costs to a practical level. Since the carbon dioxide must be introduced into the injection well under pressure in order to maintain it in the liquid or dense fluid state, the pressure adjacent a very deep subterranean formation may be extremely high, such as 2,500 p.s.i.g. or more. The method of the instant invention can be employed to adjust the fluid pressure in the formation by expending the excess pressure, i.e. that pressure due to the hydrostatic head of the fluid column which is in excess of the desired flooding pressure, in the generation of electrical energy.

Fluid engine/generators suitable for use in the method of this invention include positive displacement engines, turbines, helical screw expanders, and other devices capable of converting the motive force of a flowing stream of fluid into mechanical energy, in combination with an electrical generator for converting this mechanical energy to electrical energy. The output of the fluid engine is adapted to drive an electrical generator, either by means of directly connected drive or through suitable speed varying gears.

The fluid engine/generator must be positioned in the well and accordingly should be designed to be of suitable dimensions and capable of operating while submerged in the fluid to be injected. Suitable fluid engines have been described in the literature primarily with respect to downhole fluid engines used to drive a downhole pump or a drill bit. U.S. Pat. Nos. 2,753,801; 2,852,230; 3,076,514; 3,594,106; 3,627,048; 3,966,369; 3,976,408; and 3,986,370 disclose positive displacement engines which convert the motive force of a working fluid to mechanical energy for turning a drill bit or operating a downhole pump. U.S. Pat. No. 4,003,678 discloses a fluid operated turbo-pump. These devices can be converted for use in the method of the instant invention by rerouting the fluid exhaust so that the fluid is discharged into the bottom of the well rather than returning the fluid to the surface, and by replacing the pump or drill bit with an electrical generator. Such modifications will become obvious to those skilled in the art from this description.

Several factors must be considered in determining the suitability of a particular fluid engine/generator in a fluid injection operation. The selection of a particular fluid engine/generator is not deemed critical to this invention, but rather such selection will be within the skill of the art in view of this description. Factors to be considered in the selection of a fluid/generator include: (1) the composition of the fluid to be injected, especially as the composition might cause corrosion of, or scale formation in the fluid engine/generator; (2) the temperature and pressure conditions of the downhole environment; (3) the characteristic relationship of fluid flow rate to pressure drop through the fluid engine/generator; and (4) whether or not fluid can flow through the fluid engine/generator in the event that its rotor or impeller is jammed. Proper selection of materials of construction for the fluid engine/generator will eliminate or at least mitigate most problems caused by the first two factors, and the last two factors are generally fixed by the type of fluid engine selected, i.e. whether it is a positive displacement engine or a turbine. Of course, the last factor can be provided for by the use of a bypassing device, such as a normally closed bypass valve which opens either automatically or by remote control in the event that the fluid engine/generator is jammed.

Referring to FIG. 1, injection well 10 penetrates the earth and provides fluid communication between earth surface 12 and subterranean formation 14. Formation 14 contains connate fluid which, in the absence of fluid injection, assumes an equilibrium level in well 10, indicated as the "static level", due to the connate fluid pressure. The indicated "dynamic level" of fluid in the well represents that level of fluid required to cause the fluid to flow from well 10 into formation 14 at the desired flow rate. The dynamic level is always some distance above the static level, which distance corresponds to the hydrostatic head required to overcome the frictional resistance and force the particular rate of injected fluid into formation 14. The portion of well 10 above the dynamic level is substantially free of the injection fluid in the conventional injection operation. It is readily apparent that between surface 12 and the dynamic level there exists a substantial height of empty well, which, when filled with injection fluid, would provide a significant source of potential energy in the form of the hydrostatic head of the column of injection fluid.

According to the method of this invention, a fluid engine/generator shown generally as 15, is positioned in well 10 at a point between surface 12 and formation 14, and is supported in well 10 by packer 16 or an equivalent hanger device that fluid-tightly separates the well into an upper zone 24 and a lower zone 26. Fluid engine/generator 15 includes fluid engine 17 and generator 18 which is coupled to fluid engine 17 by drive shaft 19. The flow of injection fluid through fluid engine 17 drives generator 18 to produce electricity. The produced electricity is transmitted by electrical conductor 20 to surface 12 or other location, and is used in a conventional manner. The position of fluid engine/generator 15 in the well is indicated as "level B". Fluid communication between zone 24 and zone 26 is restricted to flow through fluid engine/generator 15 and, optionally, bypass conduit 28. Valve 30 controls the flow of fluid through bypass conduit 28 and can be remotely or automatically activated to allow bypassing of fluid engine/generator 15 in the event that fluid engine/generator 15 becomes inoperative. Valve 30 can also be employed to vary the portion of injected fluid which flows through fluid engine/generator 15. Preferably, however, fluid engine/generator 15 is selected to have a flow rate/pressure drop relationship which will render unnecessary the regular use of bypass conduit 28, and thereby maximize the flow of fluid through fluid engine/generator 15.

A level of dense fluid, indicated as "level A", is established in upper zone 24 at a point between surface 12 and the higher of level B and the dynamic level. The hydrostatic head, represented by the difference in elevation between level A and the higher of level B and the dynamic level, provides the excess downhole pressure which drives fluid engine/generator 15. Level A will be established inherently by the introduction of the fluid to be injected into well 10, however, level A can also be established by temporarily locking fluid engine/generator 15 and introducing sufficient fluid into well 10 to fill zone 24 with injection fluid to level A.

The positioning of the fluid engine/generator in the injection well, i.e., the elevation at which the fluid engine/generator is placed, can be adjusted within limits, to vary the amount of energy produced and to control the amount of pressure exerted on the subterranean formation by the injection fluid. The positioning of the fluid engine/generator is best described relative to the earth surface, the static level of the connate fluids and the dynamic level of the injection fluid. When no fluid is injected into the well from the earth surface, the connate fluids reach an equilibrium level in the injection well which is herein referred to as the "static level". When fluid is injected through the well into the formation at a fixed flow rate, the fluid reaches a different equilibrium level in the injection well which is herein referred to as the "dynamic level". At very high flow rates, the dynamic level will of course be relatively high in the well, and at very low flow rates, the dynamic level will approach the static level.

For a particular fluid engine/generator, the amount of energy produced by the fluid engine/generator is generally proportional to the flow rate through, and therefore the pressure drop across, the fluid engine/generator. The inlet pressure to the device is essentially the sum of the hydrostatic head of the standing column of fluid above the device and the pressure of the fluid at the surface. The outlet pressure will be approximately atmospheric pressure when the fluid engine/generator exhausts fluid at a point above the dynamic level, but will increase at points below the dynamic level in an amount equal to the corresponding increase in inlet pressure. Accordingly, energy production is maximized when the fluid engine/generator is positioned such that it exhausts injection fluid from a point at or below the dynamic level, but in any case the fluid engine/generator inlet must be positioned above the opening from well 10 into subterranean formation 12 in order to prevent fluid bypassing. However, there are various situations under which the fluid engine/generator may advantageously be positioned elsewhere in the well. For example, in very hot formations, such as a geothermal reservoir, it may be necessary to keep the fluid engine/generator at a higher, and therefore cooler, position in the well in order to prevent thermal damage to this device. Various other considerations in the placement of the fluid engine/generator will become obvious to those skilled in the art from this description.

In general, the fluid engine/generator will be positioned such that the injected fluid enters the fluid engine/generator at a point between the earth surface and the dynamic level for the anticipated fluid flow rate. Good results are obtained when the injected fluid enters the fluid engine/generator at a point above the dynamic level and from 500 to 5,000 feet or more below the earth surface, thus providing from 500 to 5,000 feet or more of hydrostatic head. Preferably the injected fluid enters the fluid engine/generator at a point at least about 500 feet below the earth surface and more preferably at least about 5,000 feet below the earth surface. In the absence of other considerations, it is preferred that the fluid engine/generator be positioned such that the injected fluid enters the fluid engine/generator at a point at or below the dynamic level in order to maximize production of electricity.

Figure 2:
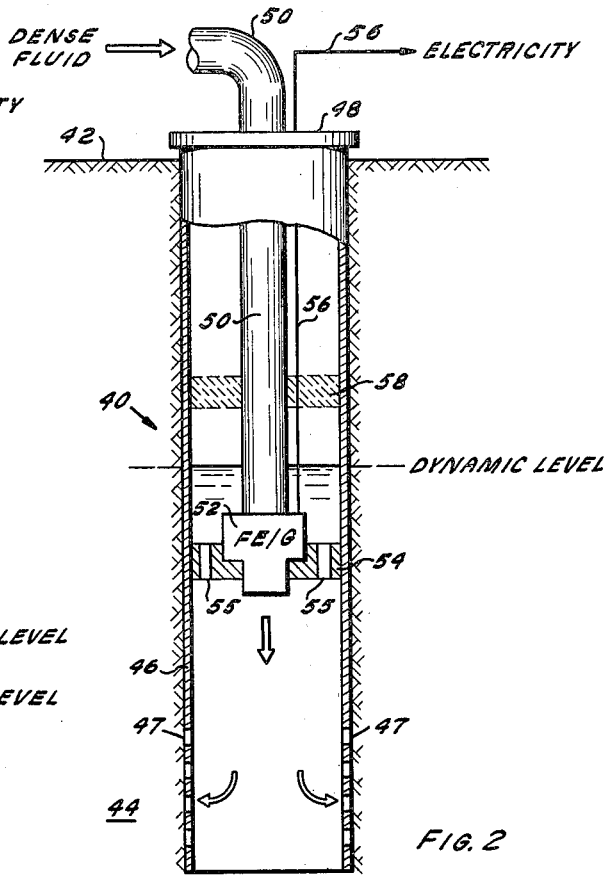
FIG. 2 is a schematic drawing of a cross-section of earth strata penetrated by an injection well illustrating another embodiment of the method of this invention.

Referring to FIG. 2, injection well 40 penetrates the earth and provides fluid tight communication between earth surface 42 and subterranean formation 44. Well 40 is lined by casing 46 which has perforations 47 for fluid communication between well 40 and formation 44, and casing head 48 for fluid tightly sealing casing 46 to tubing 50 through which the dense fluid to be injected is introduced into well 40. Tubing 50 conducts the dense fluid to fluid engine/generator 52 which is supported by hanger 54 at a position below the dynamic level in well 40. The flow of dense fluid through fluid engine/generator 52 generates electricity which is transmitted to the surface by electrical conductor 56. Hanger 54 has a pair of conduits 55 which allow free passage of fluid through hanger 54. Optionally, packer 58 is provided to fluid tightly seal the annulus between tubing 50 and casing 46.

According to the method of this invention a dense fluid is introduced into tubing 50 and caused to flow through fluid engine/generator 52 and into formation 44. The excess downhole pressure, i.e., the sum of the surface pressure plus the hydrostatic head between surface 42 and the dynamic level, is used to generate electricity. Formation 44 is exposed to a downhole pressure which is just sufficient to allow the desired rate of injection fluid to flow from well 40 into formation 44.

The well apparatus illustrated in FIG. 2 is an alternative arrangement to that illustrated in FIG. 1. The arrangement of FIG. 1 is preferred for most injection operations in which the fluid to be injected is available at the surface at about atmospheric pressure, while the arrangement of FIG. 2 may be advantageously employed in injection operations in which the fluid to be injected is pressurized prior to introduction into the well. It will be understood of course that these arrangements are merely illustrative and numerous other arrangements will become obvious to those skilled in the art from this description.

While the method of this invention will be more particularly described in conjunction with the reinjection of an effluent liquid from a geothermal power plant, it is to be recognized that the method can be employed in any process in which a dense fluid is injected through an injection well and into a subterranean formation, and in which excess downhole pressure is available.

Figure 3:
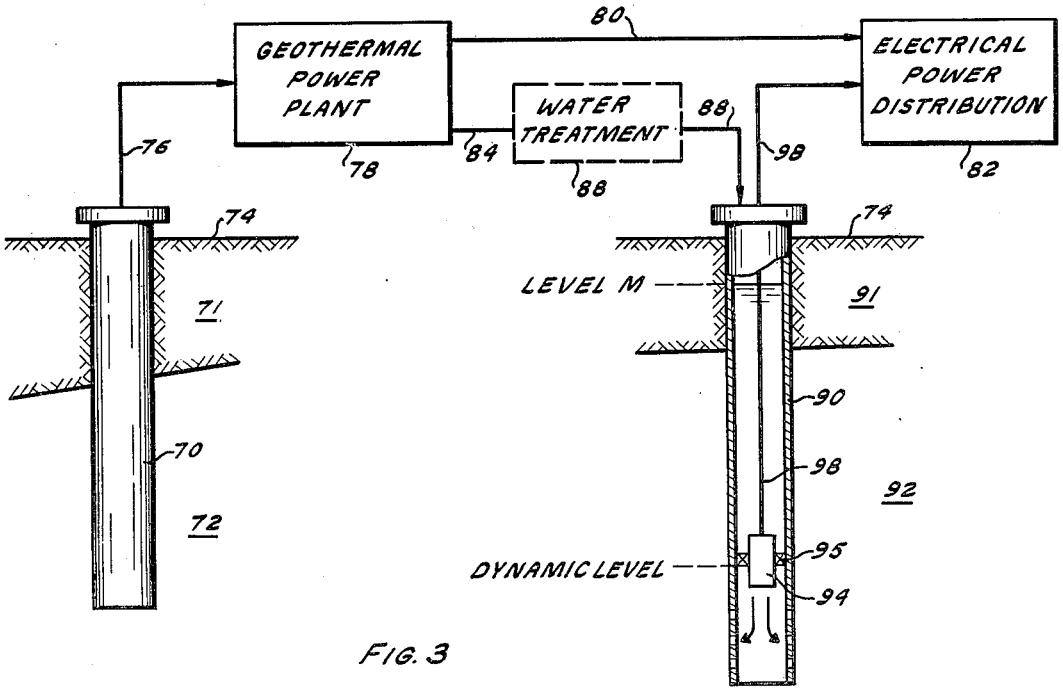
FIG. 3 is a schematic drawing of a cross-section of earth strata penetrated by a production well and an injection well which illustrates a particular embodiment of the method of this invention.

Referring to FIG. 3, production well 70 penetrates through overburden 71 and into subterranean geothermal reservoir 72 and conducts a geothermal fluid, such as steam or hot brine, from reservoir 72 to earth surface 74. The geothermal fluid is conducted by line 76 to geothermal power plant 78 wherein the thermal energy of the geothermal fluid is employed to generate electricity in a conventional manner, such as disclosed in U.S. Pat. Nos. 3,972,193 to Sherwood, 3,605,403 to Aikawa et al. or 3,988,895 to Sheinbaum. The produced electricity is transmitted by conductor 80 to electrical distribution station 82. The liquid effluent, comprised of steam condensate and/or cool brine, is conducted by line 84 to, optionally, water treatment plant 86 in order to remove scale-forming compounds and perhaps to recover mineral values from the effluent, and through line 88 to injection well 90.

Injection well 90 penetrates through overburden 91 and into a subterranean formation 92 in which the connate fluid pressure is less than the available hydrostatic head of liquid in well 90. Formation 92 can be separate from reservoir 72 or can be a remote zone of reservoir 72. Suspended at the dynamic level in well 90 by packer 95 is fluid engine/generator 94, through which the liquid effluent flows. Packer 95 fluid tightly seals the annulus between fluid engine/generator 94 and the walls of well 90 to prevent fluid bypassing of fluid engine/generator 94. The flow of liquid through fluid engine/generator 94 results in the generation of electricity. The electricity is transmitted by conductor 98 to electrical distribution station 82. Where reservoir 72 and formation 92 are in fluid communication, the bottom of injection well 90 is generally spaced a substantial distance, such as 400 yards or more, from the bottom of production well 70 to avoid a short circuit flow of cool injection fluids from injection well 90 to the vicinity of production well 70. During the injection operation, a level of liquid, indicated as "level M", is established in well 90. The height between the dynamic level and level M represents the available excess hydrostatic head which is used to generate the by-product electricity.

A preferred embodiment of the method of this invention involves an improvement in the miscible-displacement enhanced oil recovery processes in which a normally gaseous fluid is injected into a subterranean formation at high pressures to miscibly displace the oil therefrom. The downhole pressure of the displacement fluid is controlled at the desired displacement pressure, and electrical energy is produced, by positioning in the injection well a fluid engine/generator which has been selected to have a pressure drop equal to the excess downhole pressure, i.e., the downhole pressure in excess of the desired downhole pressure, at the desired fluid flow rate. The flow of injection fluid through the fluid engine/generator advantageously reduces the fluid pressure while producing electricity. As used herein, "dense fluid" includes not only the liquid condensates of the normally gaseous fluid but also the relatively dense fluid state exhibited by highly pressurized fluids at temperatures above their critical temperature.

In a particularly preferred embodiment of the method of this invention, a fluid engine/generator is positioned in an injection well during the injecton of a carbon dioxide displacement fluid through the well into a subterranean oil-bearing formation. By flowing the displacement fluid through the fluid engine/generator, by-product mechanical energy is produced while advantageously controlling the fluid pressure in the subterranean formation. As disclosed in Holm et al., "Mechanisms of Oil Displacement by Carbon Dioxide", *Journal of Petroleum Technology*, December, 1974, pp. 1427–1438 and U.S. Pat. Nos. 3,620,304 to Hearn et al. and 3,811,502 to Burnett, there exists some optimum flooding pressure, herein called the "miscible-displacement pressure", at which the amount of oil recovered by a carbon dioxide flood is essentially maximized, i.e., while the total oil recovery increases with increased carbon dioxide flooding pressures up to the miscible-displacement pressure, further increases in pressure result in relatively little, if any, increase in oil recovery. Accordingly, it is preferred to control the flooding pressure at the miscible-displacement pressure and no higher, in order to minimize compression costs.

In these processes, the flooding pressure in relatively shallow formations is effectively controlled by the discharge pressure of the injection pumps. However, in relatively deep formations the hydrostatic head of the displacement fluid in the injection well may alone exceed the desired pressure. Since the carbon dioxide displacement fluid must be introduced into the well at the earth surface at an elevated pressure in order to maintain it in the form of a liquid or dense fluid, the fluid pressure in the well adjacent the formation may exceed the desired flooding pressure by 500 p.s.i.g. or more. This excess pressure can be reduced and by-product electricity produced by the use of a suitably selected fluid engine/generator, such as a turbine/generator device with a pressure drop at the desired flow rate equal to the excess pressure, according to the method of this invention.

The invention is further illustrated by the following examples which are illustrative of specific modes of practicing the invention and are not intended as limiting the scope of the invention as defined by the appended claims.

EXAMPLE 1

Hot geothermal steam is produced from a geothermal reservoir via a production well and is processed in accordance with the method of this invention and substantially in accordance with the flow diagram illustrated in FIG. 3. The steam is conducted to geothermal power plant 78 wherein the steam is cooled by expansion in a turbine and condensed to form steam condensate in a condensor. The steam condensate is conducted to injection well 90 in which fluid engine/generator 94 has been positioned at a point below the dynamic level of the fluid, approximately 6900 feet below the earth surface. With the fluid engine/generator locked, the steam condensate is introduced to fill the portion of the well above the fluid engine/generator. The fluid engine/generator is then unlocked and the steam condensate is flowed through the well and fluid engine/generator into formation 92 at a rate of about 420,000 pounds per hour. The height of the column of liquid in the well remains substantially constant as the rate of steam condensate introduced into the well at the earth surface approximates the rate of liquid exhausted from the fluid engine/generator and into the formation. The fluid engine/generator converts the motive power of the steam condensate to electrical energy. With a generator efficiency of about 70 percent, approximately 760,000 watts of electrical power are produced. This electrical power is produced without adversely affecting the normal reinjection operation.

EXAMPLE 2

In an enhanced oil recovery operation, a displacement fluid comprising carbon dioxide is injected through an injection well and into a very deep subterranean oil-bearing formation to miscibly-displace the reservoir oil towards a production well. Under the formation conditions, miscible-displacement of the reservoir oil by the displacement fluid occurs at pressures of about 1,900 p.s.i.g. and above. Although the displacement fluid can be injected at the desired rate with a downhole pressure of 1,900 p.s.i.g., the available downhole pressure is about 2,500 p.s.i.g. due to the surface pressure required to introduce the displacement fluid into the top of the well as a dense fluid and the large hydrostatic head of fluid in the injection well. In accordance with the method of this invention, a fluid engine/generator which has a characteristic pressure drop of about 400 to 600 p.s.i. over the range of desired fluid injection rates is positioned in the injection well at a point just above the point of fluid entry into the subterranean formation. Thereafter the displacement fluid is introduced into the top of the well at the desired flow rate at a pressure sufficient to maintain the fluid in a dense fluid state throughout the well, and is flowed through the fluid engine/generator and into the formation, thereby generating electricity and reducing the pressure of the displacement fluid entering the formation to a pressure of between 1,900 and 2,100 p.s.i.g. The electricity is conducted to the earth surface and used to power the compressors which pump the injected fluid into the well. In this manner, the ultimate compression requirement is reduced because (1) less fluid is required to initially pressurize the subterranean formation to the displacement pressure and (2) a portion of the compression requirement is recovered in the production of electricity.

While particular embodiments of the invention have been described, it will be understood, of course, that the invention is not limited thereto since many obvious modifications may be made, and it is intended to include within this invention any such modifications as will fall within the scope of the appended claims.

Having now described the invention, I claim:

1. A method for the generation of electricity during the injection of a dense fluid through an injection well and into a subterranean formation having a connate fluid pressure less than the available downhole pressure of the dense fluid in the injection well, which method comprises:

placing a fluid engine/generator at a preselected position in said injection well, thereby defining upper and lower zones in said well above and below said fluid engine/generator, respectively, said fluid engine/generator including means for converting the motive power of a flowing stream of said dense fluid to electricity;

establishing a column of said dense fluid in said upper zone of said well;

flowing said dense fluid from said upper zone through said fluid engine/generator and into said subterranean formation, thereby generating electricity; and transmitting said electricity to the surface.

2. The method defined in claim 1 wherein said dense fluid is a liquid selected from the group consisting of aqueous and oleaginous liquids.

3. The method defined in claim 1 wherein said dense fluid is an aqueous liquid derived from geothermal steam or geothermal brine.

4. The method defined in claim 1 wherein said dense fluid is a normally gaseous fluid which has been compressed to a relatively dense liquid-like state at temperatures above its critical temperature.

5. The method defined in claim 4 wherein said dense fluid comprises carbon dioxide which has been compressed to a relatively dense liquid-like state at temperatures above its critical temperature.

6. The method of claim 1 wherein said fluid engine/generator includes a fluid engine, an electrical generator and means for mechanically coupling said engine to said generator, and wherein the flow of said dense fluid through said engine results in the generation of electricity.

7. The method of claim 6 wherein said fluid engine is selected from the group consisting of turbines and positive displacement engines, and wherein said fluid engine/generator further includes means for allowing said dense fluid to bypass said fluid engine/generator when said fluid engine/generator is inactivated.

8. The method of claim 1 wherein said preselected position is at least 500 feet below the earth surface but above said subterranean formation.

9. The method of claim 1 wherein said preselected position is at least 5,000 feet below the earth surface but above said subterranean formation.

10. In a method for generating electricity wherein a hot geothermal fluid is produced from a subterranean geothermal reservoir, the thermal energy of the hot fluid is extracted therefrom to produce a cool geothermal liquid, and the geothermal liquid is injected through an injection well into a subterranean formation having a connate fluid pressure less than the available hydrostatic head of the geothermal liquid in the injection well, the improvement comprising:

placing a fluid engine/generator at a preselected position in said injection well, said fluid engine/generator including means for converting the motive power of a flowing stream of said geothermal liquid to electricity, said preselected position being at least about 5,000 feet below the earth surface but above said subterranean formation;

establishing in said injection well a column of said geothermal liquid above said fluid engine/generator;

flowing said geothermal liquid through said fluid engine/generator and into said subterranean formation, thereby generating electricity; and transmitting said electricity to the earth surface.

11. In the method for recovering oil from a subterranean formation, in which a displacement fluid comprising a normally gaseous fluid is introduced into the top of an injection well as a dense fluid and is flowed downwardly through said injection well to a downhole point adjacent said subterranean formation and into said formation to displace oil through the formation to a production well, the pressure of said displacement fluid at said downhole point being in excess of a desired displacement pressure, the improvement comprising:

positioning a fluid engine/generator at a preselected position in said injection well, said fluid engine/generator including means for converting the motive power of a flowing stream of said displacement fluid to electricity thereby reducing the pressure of said displacement fluid;

introducing said displacement fluid into the top of said injection well at the desired fluid injection rate and at a pressure sufficient to maintain said displacement fluid in the dense fluid state throughout said injection well;

flowing said displacement fluid through said fluid engine/generator and into said subterranean formation, thereby generating electricity and reducing the pressure of said displacement fluid at said downhole point to about said desired displacement pressure; and transmitting said electricity to the earth surface.

12. The method of claim 11 wherein said displacement fluid is a fluid selected from the group consisting of carbon dioxide, nitrous oxide and the normally gaseous hydrocarbons having from 1 to 6 carbon atoms per molecule.

13. The method of claim 11 wherein the pressure of said displacement fluid at said downhole point is at least about 500 p.s.i. in excess of said desired displacement pressure.

14. The method of claim 11 wherein the desired displacement pressure is the pressure at which said dense fluid miscibly displaces said oil.

15. In the method for recovering oil from a subterranean formation by miscible-displacement of the oil with a displacement fluid comprised of carbon dioxide, wherein said displacement fluid is introduced into the top of an injection well as a dense fluid, and is flowed downwardly through said injection well to a downhole point adjacent said formation and into said formation to miscibly displace oil through the formation to a production well, the pressure of said displacement fluid at said downhole point being at least about 500 p.s.i. above the miscible-displacement pressure, the improvement comprising:

positioning a fluid engine/generator at a preselected position in said injection well, said fluid engine/generator including means for converting the motive power of a flowing stream of said displacement fluid to electrical energy and thereby reduce the pressure of said displacement fluid;

introducing said displacement fluid into the top of said injection well at the desired flow rate and at a pressure sufficient to maintain said displacement fluid in the dense fluid state throughout the well;

flowing said displacement fluid through said fluid engine/generator and into said subterranean formation, thereby generating electricity and reducing the pressure of said displacement fluid at said downhole point to about said miscible-displacement pressure; and transmitting said electricity to the earth surface.

* * * * *